US007131609B1

(12) United States Patent
Lewis et al.

(10) Patent No.: US 7,131,609 B1
(45) Date of Patent: Nov. 7, 2006

(54) DISPENSER FOR SHEET MATERIAL

(75) Inventors: Richard Paul Lewis, Marietta, GA (US); Paul Francis Tramontina, Alpharetta, GA (US); Randy LeCates, Monroeville, NJ (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 11/216,730

(22) Filed: Aug. 31, 2005

(51) Int. Cl.
*B65H 18/02* (2006.01)

(52) U.S. Cl. ..... 242/593; 242/615.3; 242/615.4; 242/132; 206/409; 220/253

(58) Field of Classification Search ..... 242/593, 242/132, 137, 146, 615.3, 615.4; 206/409, 206/390, 394, 205, 210, 812; 220/253; 221/62, 221/63

See application file for complete search history.

(56) References Cited

U.S. PATENT DOCUMENTS 995,203 A * 6/1911 Thomas et al. ..... 220/253
5,370,338 A * 12/1994 Lewis ..... 242/593
5,749,492 A * 5/1998 Petterson ..... 221/62
5,765,718 A * 6/1998 Grasso et al. ..... 221/62
6,267,321 B1 * 7/2001 Tramontina ..... 242/593
6,328,252 B1 * 12/2001 Neveu et al. ..... 242/593
6,510,964 B1 * 1/2003 Paukov et al.
6,575,397 B1 * 6/2003 Tramontina et al. ..... 242/593
6,592,001 B1 * 7/2003 Lewis et al. ..... 221/63
6,629,667 B1 * 10/2003 Tramontina ..... 242/593
6,869,041 B1 * 3/2005 Allegre et al. ..... 242/593
7,040,568 B1 * 5/2006 Lewis et al. ..... 242/593

* cited by examiner

*Primary Examiner*—William A. Rivera
(74) *Attorney, Agent, or Firm*—Sue C. Watson

(57) ABSTRACT

A dispenser adapted to dispense sheet material therefrom is provided and includes a housing including a base and a cover. The base includes a platform configured to support sheet material. The platform includes a dispensing disk and the platform has an outer perimeter intersected by a slot thereby providing an opening into the platform and dispensing disk. The housing is formed to include an exit port spaced apart from the platform and dispensing disk. The cover includes a rotatable disk having a plurality of user interchangeable dispensing slots of differing diameters intersecting an outer periphery of the rotatable disk. Sheet material positioned on the platform flows through the dispensing opening of the dispensing disk and through a selected one of the plurality of dispensing slots. The selected one of the plurality of dispensing slots is aligned with the exit port. The sheet material disposed in the dispenser flows between the opening in the dispensing disk, through at least one space, through the selected one of the plurality of dispensing slots and through the exit port to be dispensed.

36 Claims, 11 Drawing Sheets

DISPENSER FOR SHEET MATERIAL

BACKGROUND

Dispensers for rolls or stacks of sheet material have an exit port which usually permits one sheet material at a time to be dispensed therethrough. Many dispensers which dispense sheet materials are sufficiently complicated to load and re-load that excessive or inadequate dispensing of sheet materials occurs.

Even when a dispenser is operating properly, it can be difficult for an operator to thread newly loaded sheet material through a small or difficult to access opening in a dispensing port. Therefore, reloading provides difficulties for an operator each time new sheet material is disposed in the dispenser.

Problems are also caused in many dispensers when different products are used. That is, sheet material products from various manufacturers often have their own characteristics. The caliper and basis weight of the sheet material of each product will likely be different. Further, the machine direction tensile of the sheet material will vary in different products. Moreover, the tab strength of each sheet material will also vary product-to-product. These differing characteristics of each product type often result in excessive or inadequate dispensing of sheet materials as well.

Therefore, in view if these issues, it would be advantageous to have a dispenser for sheet material which permits an operator to quickly and easily load and thread different product types of sheet material using, for example, one hand, and which is easy to adjust for different product types. In addition, it would be advantageous to have a dispenser which permits easy and rapid adjustment for proper dispensing of one sheet at a time to a user based on the characteristics of the sheet material. Such easy and rapid adjustment would desirably be accomplished without the need for threading sheet material through one or more closed orifices.

DEFINITIONS

As used herein, the term "caliper" refers to the thickness measurement of a sheet taken under constant force. The caliper may be determined using test method number TAPPI 411-OM-89.

As used herein, the term "basis weight" (hereinafter "BW") is the weight per unit area of a sample and may be reported as gram-force per meter squared and may be hereinafter calculated using test procedure ASTM D3776-96.

As used herein, the term "machine direction" (hereinafter "MD") is the direction of a material parallel to its forward direction during processing.

As used herein, the term "machine direction tensile" (hereinafter MDT) is the breaking force in the machine direction required to rupture a specimen. The results may be reported as gram-force and abbreviated as "gf". The MDT may be determined using test method number ASTM D5035-95.

As used herein, the term "tab strength" is the breaking force in the machine direction required to rupture a sheet product along its perforations. The results may be reported as gram-force and abbreviated as "gf".

As used herein, the term "exit port" or "dispensing port" is the opening in a housing of a dispenser for the passage of sheet material out of the dispenser.

As used herein, the term "centerflow roll" or "centerflow roll product" means sheet material wound cylindrically about a center, but permitting the removal of material from the center. Desirably, as the centerflow roll is consumed, sheet material eventually dispenses from the roll's periphery. Dispensing of centerflow roll products are described in numerous patents, such as, but not by way of limitation, U.S. Pat. No. 5,370,338 to Lewis and U.S. Pat. No. 6,082,663 to Tramontina et al.

As used herein, the term "sheet material" means a material that is thin in comparison to its length and breadth. Generally speaking, sheet materials should exhibit a relatively flat planar configuration and be flexible to permit folding, rolling, stacking, and the like. Exemplary sheet materials include, but are not limited to, paper tissue, paper towels, label rolls, or other fibrous, film, polymers, or filamentary products.

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "configure" or "configuration" means to design, arrange, set up, or shape with a view to specific applications or uses. For example: a military vehicle that was configured for rough terrain; configured the computer by setting the system's parameters.

As used herein, the term "couple" includes, but is not limited to, joining, connecting, fastening, linking, or associating two things integrally or interstitially together.

As used herein, the term "hinge" refers to a jointed or flexible device that connects and permits pivoting or turning of a part to a stationary component. Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

These terms may be defined with additional language in the remaining portions of the specification.

SUMMARY OF THE INVENTION

In one aspect of the invention, a dispenser adapted to dispense sheet material therefrom is provided and includes a housing including a base and a cover. The base includes a platform configured to support sheet material. The platform includes a dispensing disk and the platform has an outer perimeter intersected by a slot thereby providing an opening into the platform and dispensing disk. The housing is formed to include an exit port spaced apart from the platform and dispensing disk. The cover includes a rotatable disk having a plurality of user interchangeable dispensing slots of differing diameters intersecting an outer periphery of the rotatable disk. Sheet material positioned on the platform flows through the dispensing opening of the dispensing disk and through a selected one of the plurality of dispensing slots. The selected one of the plurality of dispensing slots is aligned with the exit port. The sheet material disposed in the dispenser flows between the opening in the dispensing disk, through at least one space, through the selected one of the plurality of dispensing slots and through the exit port to be dispensed.

DETAILED DESCRIPTION

Figure 1:
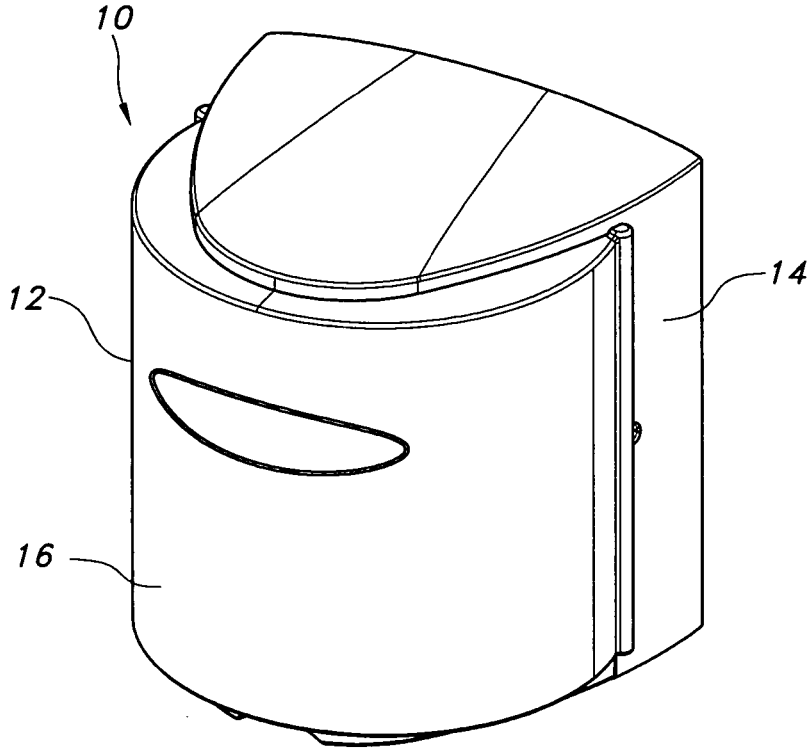
FIG. 1 is a perspective view of a dispenser for sheet material from the upper end of the dispenser showing the dispenser in a closed dispensing position.

Reference will now be made in detail to the presently preferred embodiments of the invention, one or more examples of which are illustrated in the drawings. Each example is provided by way of explanation of the invention and is not meant as a limitation of the invention. For example, features illustrated or described as part of one embodiment or figure can be used on another embodiment or figure to yield yet another embodiment. It is intended that the present invention include such modifications and variations.

The present invention provides an apparatus for dispensing sheet material, and desirably, rolled sheet material. Such rolled material may include, but is not limited to, woven materials, nonwoven materials, synthetic materials, natural materials, foils, polymer films, any combination thereof, and so forth. Desirably, the rolled material is provided as a sheet material within a roll. Exemplary sheet materials for which the present invention is suitable include, but are not limited to, absorbent sheet materials such as towels, wipers, tissue, and so forth. Suitable sheet materials are disclosed, by way of non-limiting examples only, in U.S. Pat. No. 5,048,589 to Cook et al., U.S. Pat. No. 5,399,412 to Sudall et al., U.S. Pat. No. 5,674,590 to Anderson et al., U.S. Pat. No. 5,772,845 to Farrington, Jr. et al., U.S. Pat. No. 5,904,971 to Anderson et al., U.S. Pat. No. 6,248,212 to Anderson et al., and U.S. Pat. No. 6,273,996 to Hollenberg et al., the entire contents of which are herein incorporated by reference. The sheet materials for which the present invention is suitable may be wound around a core (not shown). Desirably, the sheet materials used in the present invention are provided in a centerflow roll, wherein the roll unwinds from the inner core. Alternatively, the sheet material may be wound into a coreless roll, and the roll may be unwound from the outer circumference.

The sheet material for which the present invention is suitable desirably has regularly spaced zones of weakness extending substantially across the width of the sheet material. The zones of weakness are used to separate the sheet material into individual sheets and may be, for example, defined by a series of perforations, a zone of much lower basis weight, and so forth. The sheet material having regularly spaced zones of weakness substantially extending across its width is desirably double wound into a roll having inner and outer layers of sheet material. Desirably, but not by way of limitation, the zones of weakness for the inner and outer layers are offset as is taught in U.S. Pat. No. 3,770,172 to Nystrand, herein incorporated by reference in its entirety. Double wound sheet material having offset zones of weakness allows the sheet material to tear within the dispenser while still providing a tail of sheet material extending from the dispenser to be grasped by the next patron or user.

Illustrated in FIGS. 1–8B is a dispenser 10 for sheet material. The dispenser 10 includes a dispenser housing 12. The dispenser housing 12 includes a base 14 and a cover 16.

Figure 2:
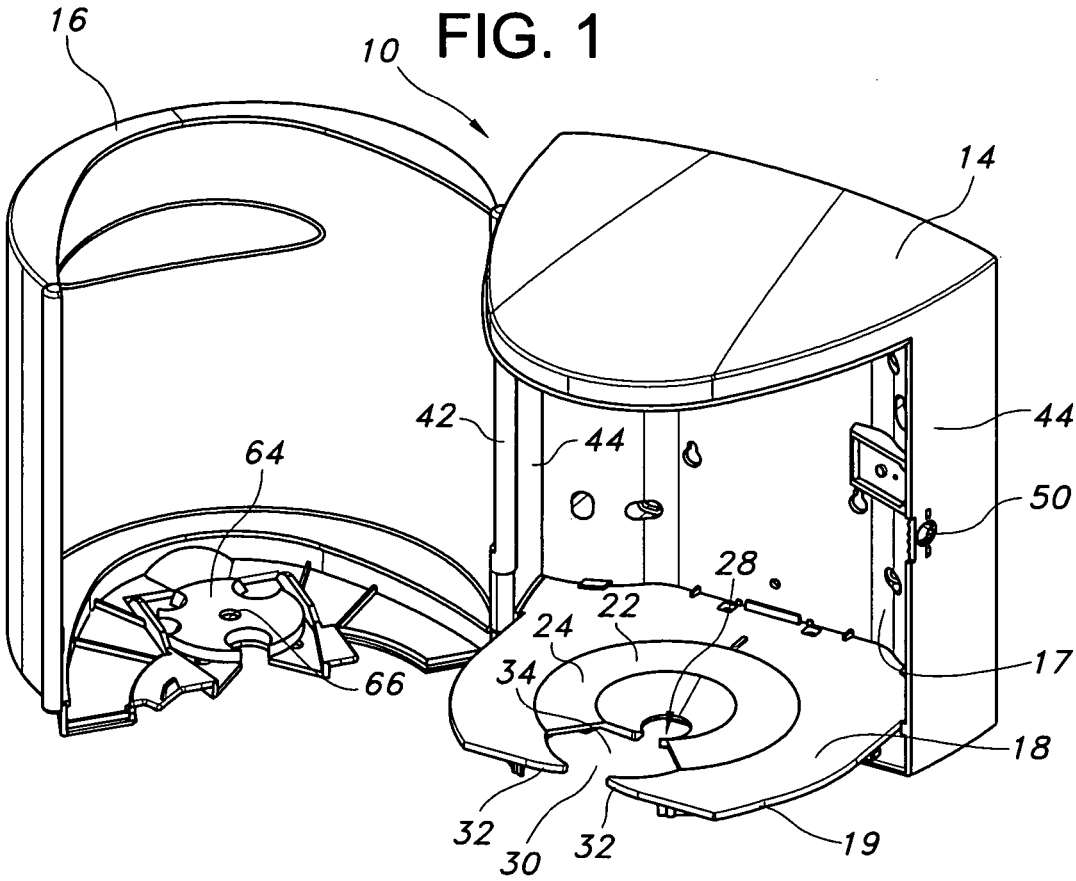
FIG. 2 is an upper perspective view of the dispenser of FIG. 1, showing the dispenser in an opened loading position for loading a roll of centerflow sheet material therein (not shown)
Figure 3:
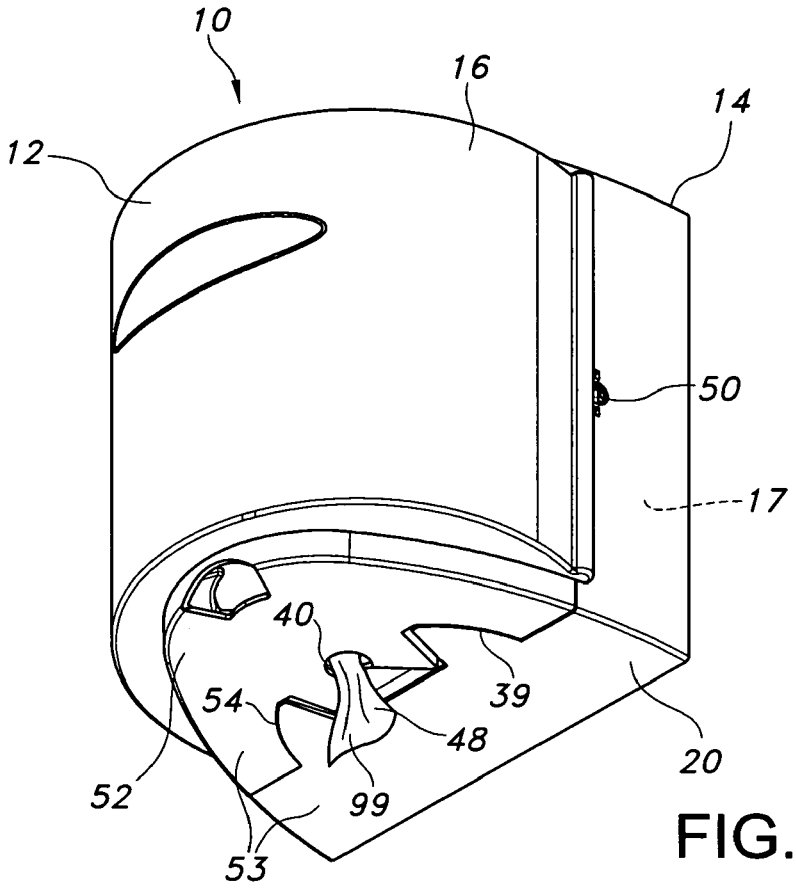
FIG. 3 is a perspective view of the dispenser for sheet material of FIG. 1 from the lower end of the dispenser, showing sheet material extending from an exit port.
Figure 4A:
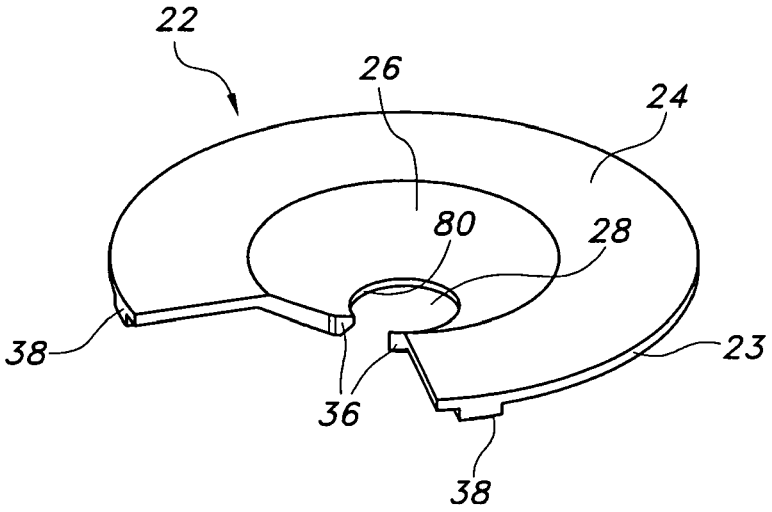
FIG. 4A is a perspective view of a dispensing disk of FIG. 2.
Figure 4B:
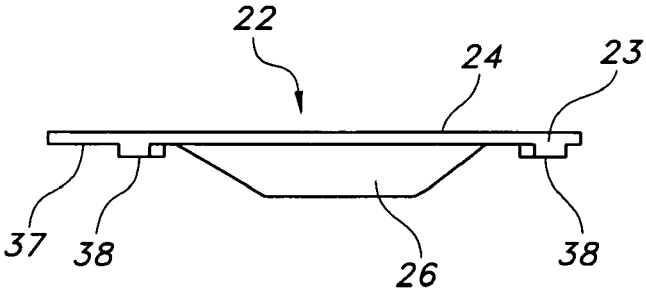
FIG. 4B is a side view of the dispensing disk of FIG. 4A.

As shown in FIGS. 1–3, the base 14 is configured to permit attachment of the dispenser 10 to a wall or suitable surface (not shown). The base 14 includes at least a back plate 17 and a roll platform 18 having an outer perimeter edge 19 which is positioned near a lower end 20 of the base 14. The platform 18 desirably includes a dispensing disk 22. The dispensing disk 22 may be provided as a separate disk, as illustrated in FIGS. 4A and 4B, or, alternatively, the dispensing disk 22 may be formed as an integral portion of the platform 18 (not shown). Desirably, the outer perimeter edge 19 of the platform 18 and/or an outer perimeter edge 23 of the dispensing disk 22 may be formed with at least a portion of the perimeter edge 23 having a circular or semi-circular configuration. It will be understood, however, that any shape, design and/or configuration of any component of the dispenser that permits the dispenser to operate as shown and/or described herein may be used. The platform 18 and/or the dispensing disk 22 is configured to hold sheet material, and desirably may hold a roll of sheet material, such as a centerflow roll of sheet material.

The dispensing disk 22 may include a flat upper surface 24 near the perimeter edge 23, and it may also include at least a portion of a generally frustoconically-shaped section 26 intersected by a dispensing opening 28 and an open feed slot or section 30. The open feed slot or section 30 intersects the outer peripheral edge 19 of the roll platform 18 and the outer periphery edge 23 of the dispensing disk 22 and extends into the dispensing opening 28. A portion of the open feed section 30 is formed by the periphery of narrowly spaced apart arms 32 formed as a portion of the roll platform 18, and an irregularly-shaped large opening 34 which is provided by the outer perimeter edges 19, 23 of the roll platform 18 and the dispensing disk 22, respectively. A portion of the dispensing disk 22 has narrowly spaced-apart arms 36 which cooperate to provide a portion of the open feed slot or section 30 and define an opening therebetween into the dispensing opening 28. A lower surface 37 of the dispensing disk 22 may include locking tabs 38 which hold the disk to the roll platform 18. It is notable that the irregular large opening 34 is configured, but not by way of limitation, to be larger than the dispensing opening 28 to provide ease in threading sheet material from the roll platform 18 to an exit port (shown in FIG. 2). The cover 16 provides components which control a sheet of material threaded through the open feed section 30.

The lower end 20 of the base 14 provides a dispensing edge 39 which defines at least a portion of an exit port 40 which intersects the housing 12 and through which sheet material flows therefrom. The cover 16 provides the remaining components, as will be described below.

The cover 16, as illustrated in FIGS. 1–3, may be coupled to one side of the base 14 via at least one hinge 42. The hinge 42 is desirably secured to both a portion of the base 14, in this instance a sidewall 44 as well as to a portion of the cover 16. The hinge 42 permits the cover 16 to pivot away from the base 14, to permit complete access to the base 14, platform 18, the roll 46 of centerflow sheet material 48, and so forth. While a hinge is used in the present embodiment, it will be understood that other fasteners or fastening mechanisms may be used.

A latching assembly (not shown) may be positioned on a side wall of the base 14 and a portion of the cover 16 (not shown), along with a push button release 50 (FIG. 2) to secure the cover 16 in a closed position, for illustrative purposes. It will be appreciated that a tamper-proof fastener or latch (not shown) will desirably be used to permit only an operator access to the centerflow roll 46 of sheet material 48 contained in the dispenser 10. The cover 16 or any component of the housing 12 may be formed from an opaque material. Alternatively, the cover 16, the housing 12, or any portion thereof may be formed from a clear, tinted, or translucent material, so that a reduction in the centerflow roll 46 disposed in the dispenser 10 may be observed by an operator. The cover 16 or any portion of the housing 12 may be rounded to at least partially follow the curvature of the centerflow roll 46 of sheet material 48 positioned therein. This configuration is non-limiting, and it will be appreciated that other shapes and configurations for the cover, base and/or housing may be used. The housing 12 or any portion (s) thereof may be formed from any suitable material, including, but not limited to, metal, plastic, and so forth.

The cover 16 has a lower end portion 52 which, when positioned against the lower end 20 of the base 14, provides a lower end 53 of the housing 12. The lower end portion 52 includes a dispensing edge portion 54 which cooperates with the dispensing edge 38 of the lower end 20 of the base 14 to provide the exit port 40 when the cover 16 is positioned in a closed dispensing position against the base 14.

The lower end portion 52 includes either integrally or as a separate component (not shown) a mounting plate 56 which desirably includes mounting disk aperture 58. Additional mounting apertures 59 may be included, and there purpose is described below. A slot 60 is formed in the mounting plate 56. The slot 60 may be semi-circular, semi-elliptical, or any shape or configuration which permits it to operate as shown and/or described herein. A portion of the dispensing edge 54 may desirably provide a generally V-shaped or U-shaped slot edge 62 into the slot 60. A rotatable disk 64 is desirably rotatably mounted to the mounting plate 56 via a fastener 66 which extends through a central aperture 68 on the rotatable disk 64 and into the mounting aperture 58. It will be appreciated that the fastener 66 may be a snap plug, a threaded fastener, a non-threaded fastener, and so forth.

The rotatable disk 64 includes an upper surface 70, a lower surface 72 and an outer periphery 74. The rotatable disk 64 has a plurality of user interchangeable dispensing slots 76 of differing diameters 78 intersecting the outer periphery 74 of the rotatable disk 64. Each of the plurality of dispensing slots 76 has a diameter 78 of a different size relative to an adjacent or nearest dispensing slot 76. In addition, each dispensing slot 76 is desirably, but not by way of limitation, at least semicircular or semi-elliptical in configuration or shape. When the dispenser is in the opened loading position, as shown in FIG. 2, a dispensing slot 76 is desirably selected in view of the characteristics of the roll 46 of sheet material 48. That is, a dispensing slot 76 having a diameter that facilitates proper dispensing of sheet material 48 from the roll 46 is selected. Once selected, the disk 64 is rotated and the selected dispensing slot 76 is desirably oriented axially with the slot 60 in the mounting plate 56. This orientation and selection, and other alternatives are discussed in further detail below.

Figure 5A:
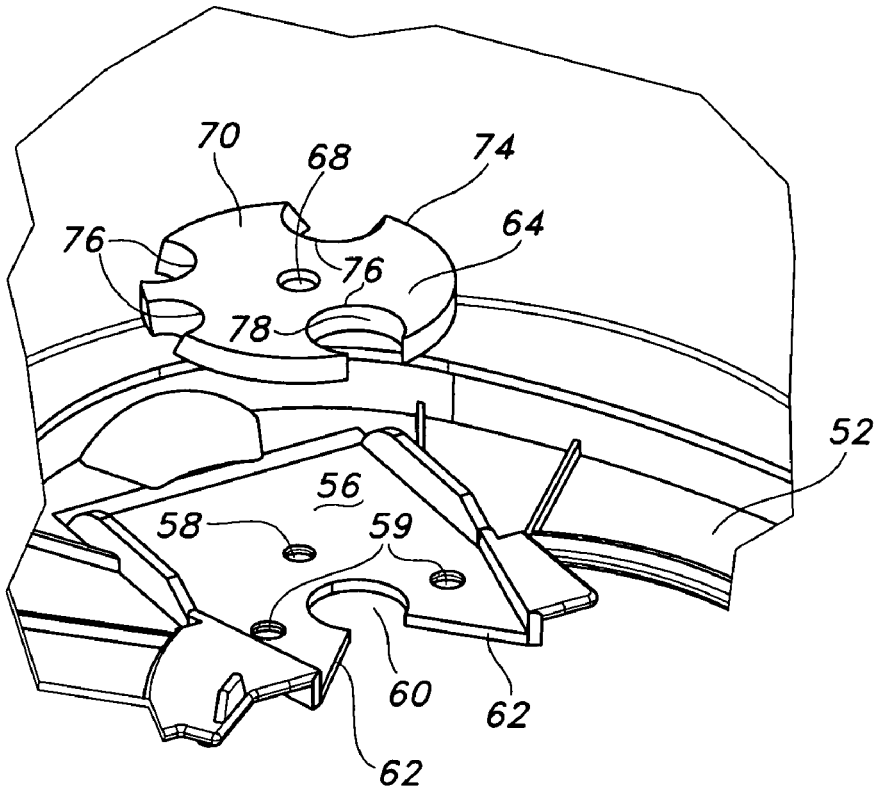
FIG. 5A is a perspective exploded view of a lower end portion of the cover of FIG. 2, showing a rotatable disk positioned above a mounting plate.
Figure 5B:
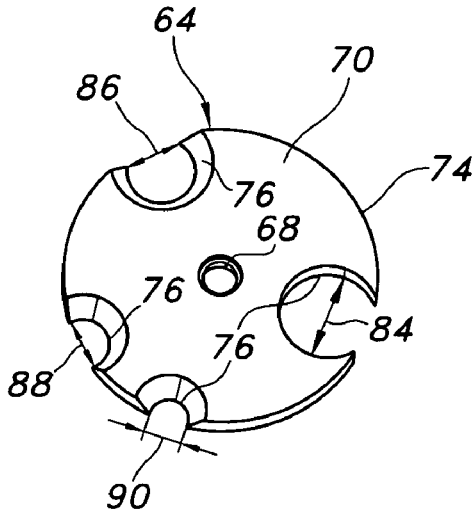
FIG. 5B is an upper perspective view of the rotatable disk of FIG. 5A.
Figure 5C:
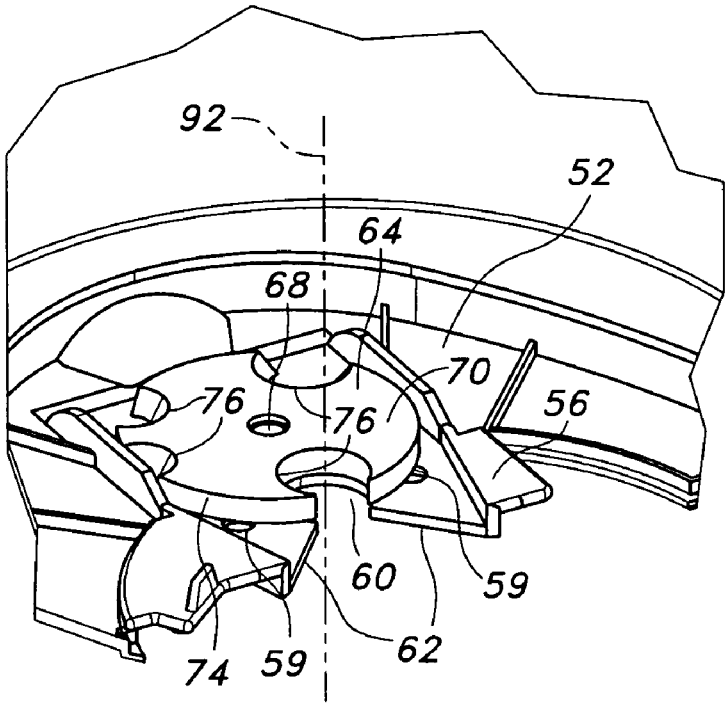
FIG. 5C is a perspective view of FIG. 5A, but with the rotatable disk rotatably coupled to the mounting plate, a dispensing slot on the rotatable disk positioned in alignment with a slot on the mounting plate.
Figure 5D:
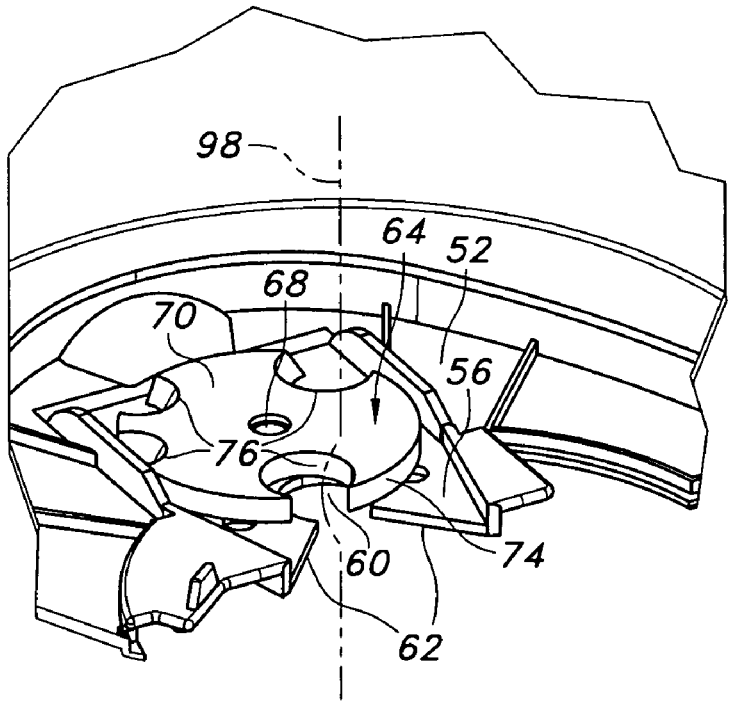
FIG. 5D is a perspective view similar to FIG. 5C, but showing a dispensing slot on the rotatable disk positioned partially out of alignment with the slot on the mounting plate.
Figure 6A:
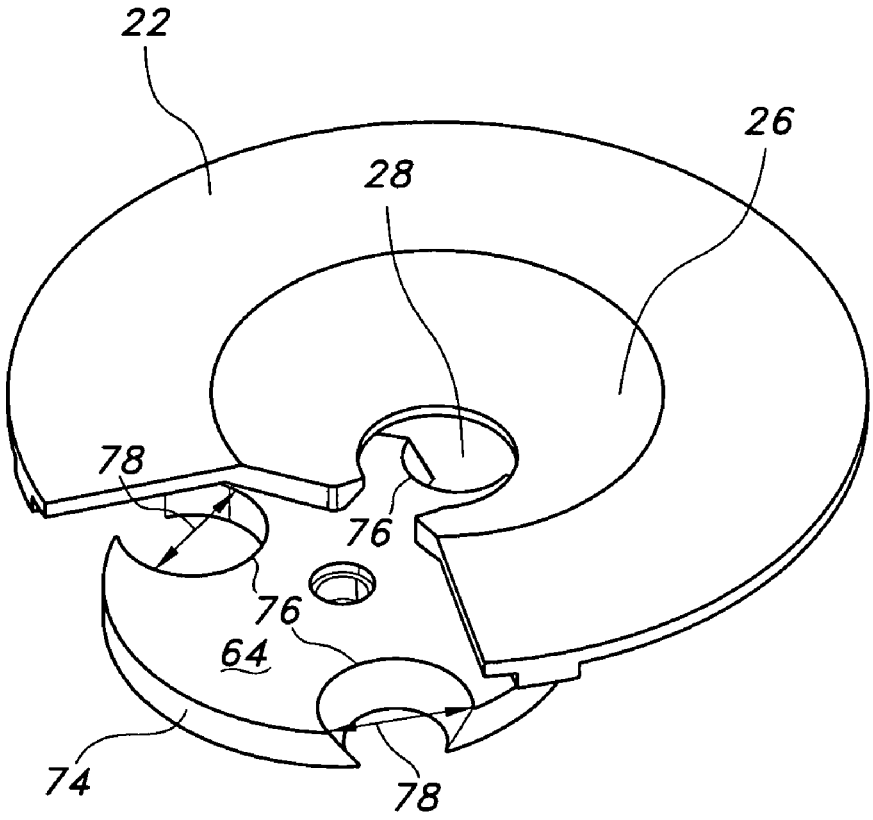
FIG. 6A is a perspective view of the dispensing disk and the rotatable disk when they are positioned in a closed, dispensing position.
Figure 6B:
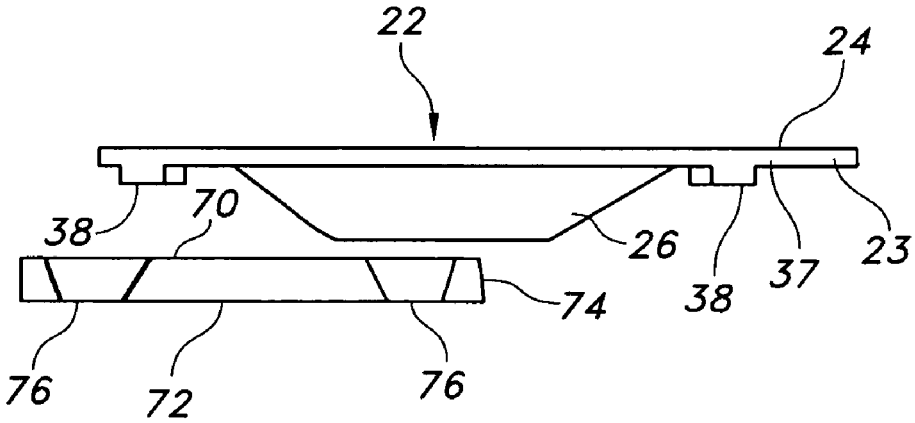
FIG. 6B is a side view of the dispensing disk and rotatable disk of FIG. 6A.

FIGS. 6A–9B illustrate the position of the dispensing disk 22, the rotatable disk 64 and the mounting plate 56 when the cover 16 is closed against the base 14 in a closed dispensing position. In this dispensing position, at least a portion of the rotatable disk 64 is positioned below the dispensing opening 28 in the dispensing disk 22. This action desirably occurs after one of the plurality of dispensing slots 76 is selected for its diameter size and is positioned in general axial alignment with the slot 60 in the mounting plate 56. In the closed, dispensing position, the slot 60 in the mounting plate 56 and the selected dispensing slot 76 is positioned so that it extends generally below the dispensing opening 28 in the dispensing disk 22 in an axial alignment. It will be appreciated, however, as shown in FIG. 5C, that the alignment of the dispensing slot 76 need not be a perfectly axially aligned with the dispensing opening 28 and/or the slot 60 in the mounting plate 56. Indeed, the dispensing slot 76 may be offset, that is, positioned in a non-axially aligned position if desired. This flexibility in alignment or degree or amounts of non-alignment of each dispensing slot 76 relative to the slot 60 in the mounting plate 56 below and relative to the dispensing opening 28 in the dispensing disk 22 above permits greater tensioning of sheet material 48. That is, as sheet material 48 flows against the inner periphery edge 80 formed in the dispensing disk 22 which forms the dispensing opening 28 and the inner periphery edge 82 of each dispensing slot 76, each inner periphery edge 80, 82 contributes to tensioning or lack thereof against the sheet material 48, depending upon its position relative to the sheet material 48. If the selected dispensing slot 76 of the rotatable disk 64 is axially aligned with the dispensing opening 28 and the slot 60 in the mounting plate 56, there is less tension. If the selected slot 76 of the rotatable disk 64 is slightly non-aligned with the dispensing opening 28 and the slot in the mounting plate 56, as shown in FIG. 5C, there is greater tension. In addition, the size of the diameter 78 of each dispensing slot 76 contributes to greater or lesser tensioning of the sheet material 48 whether the dispensing slot 76 is axially aligned or in a non-axial alignment with the dispensing opening 28 of the dispensing disk 22 and the slot 60 of the mounting plate 56. Larger diameter dispensing slots 76 result in less tensioning. Smaller diameter slots 76 result in greater tensioning. The diameter of the dispensing slots 76 is delineated by numerals 84–90, with numeral 84 defining the largest diameter 78, and the numerals 86–90 each defining progressively smaller diameters of the dispensing slots 76.

The larger diameter of the dispensing opening 28 of the dispensing plate 22, the selected dispensing slot 76 and the slot 60 in the mounting plate 56 causes less frictional resistance, and is used with a thicker, i.e., greater basis weight sheet material products to provide separation along perforations or areas of weakness of the sheet material 48 to facilitate proper dispensing of sheet material 48. Thinner, namely lesser basis weight sheet material products require a smaller diameter of the dispensing opening 28 of the dispensing plate 22, the selected dispensing slot 76 and the slot 60 in the mounting plate 56 to provide separation along perforations or areas of weakness of the sheet material 48.

It will be appreciated that, if the dispensing disk 22 is a separate component, then several dispensing disks having a variety of diameters may be provided with the dispenser 10. Alternatively, however, is will be understood that when the dispensing disk is formed integrally with the roll platform 18, the dispensing opening 28 will be a specific, fixed diameter which is cannot be readily altered.

Desirably, but not by way of limitation, the slot 60 in the mounting plate 56 is of a fixed size. Therefore, the primary adjustment for proper dispensing of sheet material 48 through the exit port 40 of the dispenser 10 will be via selection of one of the plurality of dispensing slots 76 on the rotatable disk 64. The axial alignment or axial non-alignment of the dispensing slot 76 relative to the dispensing opening 28 of the dispensing disk 22 and the slot 60 in the mounting plate 56 may also be used.

Figure 7A:
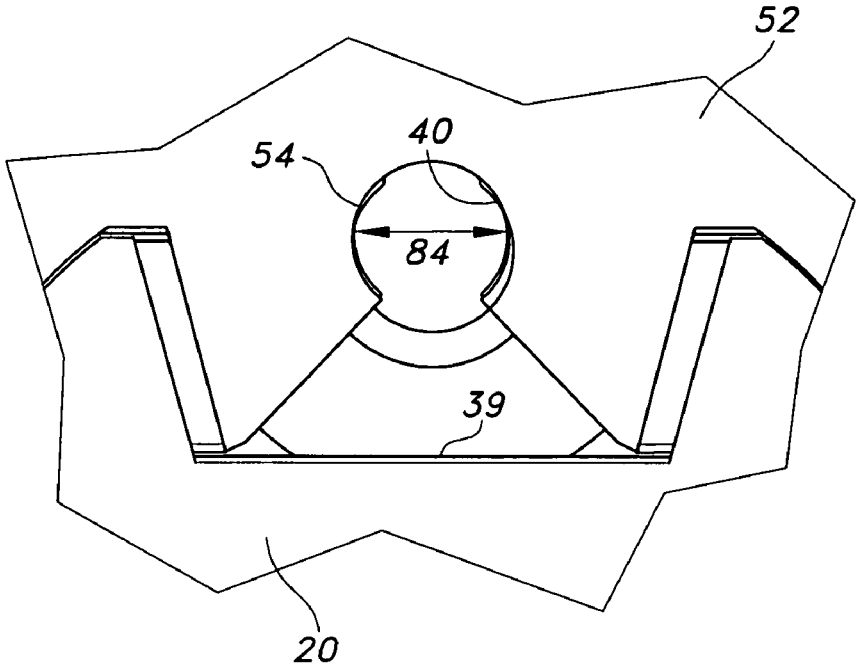
FIG. 7A is a plan view of the lower end of the dispenser showing the exit port and a section of the lower end of the housing, and showing a largest diameter of a dispensing slot in the rotatable disk for dispensing sheet material therethrough.
Figure 7B:
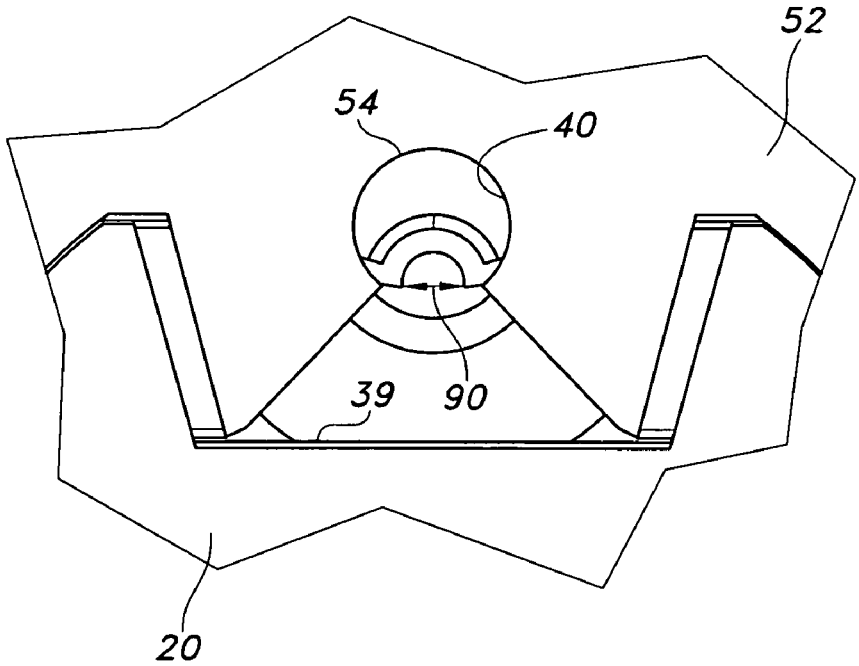
FIG. 7B is a plan view similar to FIG. 7A, but showing a smallest diameter of a dispensing slot in the rotatable disk for dispensing sheet material therethrough.
Figure 8A:
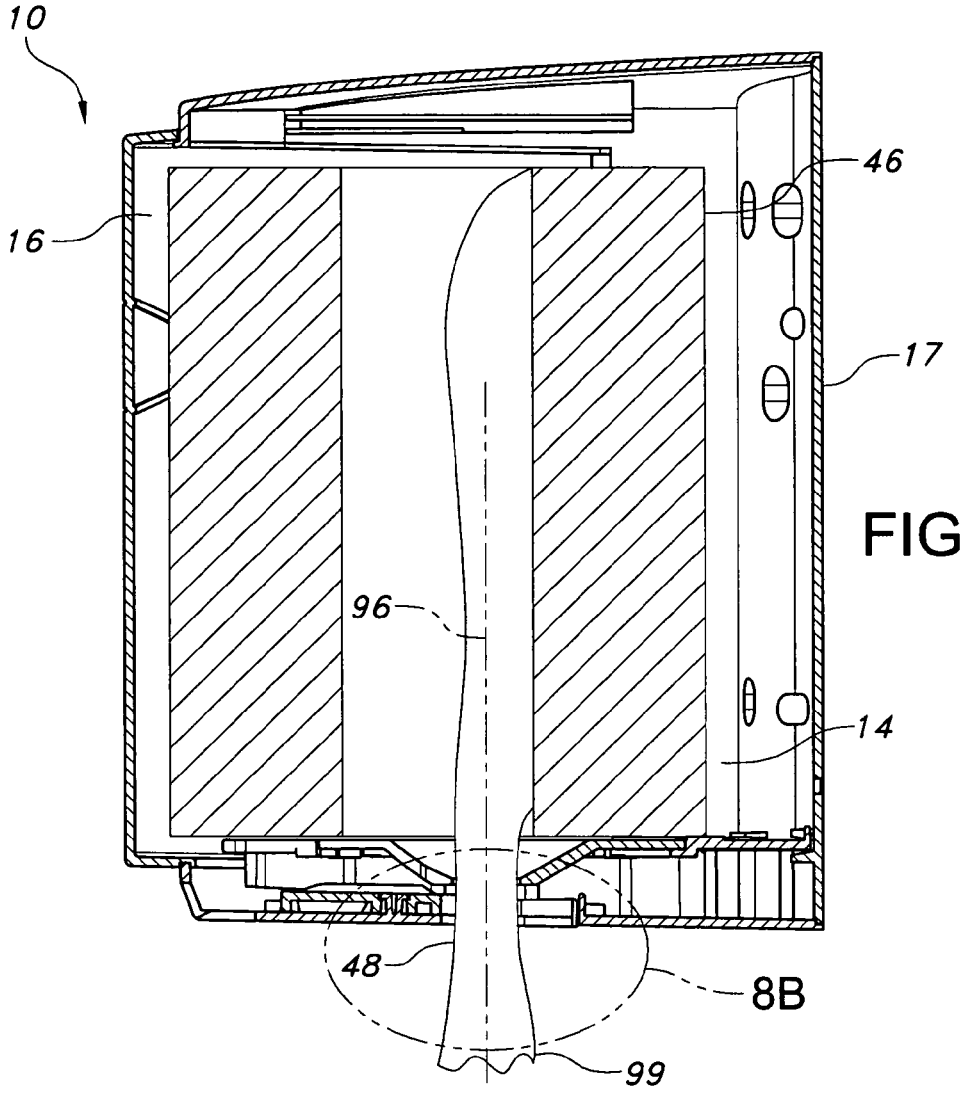
FIG. 8A is a sectional view of the dispenser of FIG. 3, taken along lines 8A—8A.
Figure 8B:
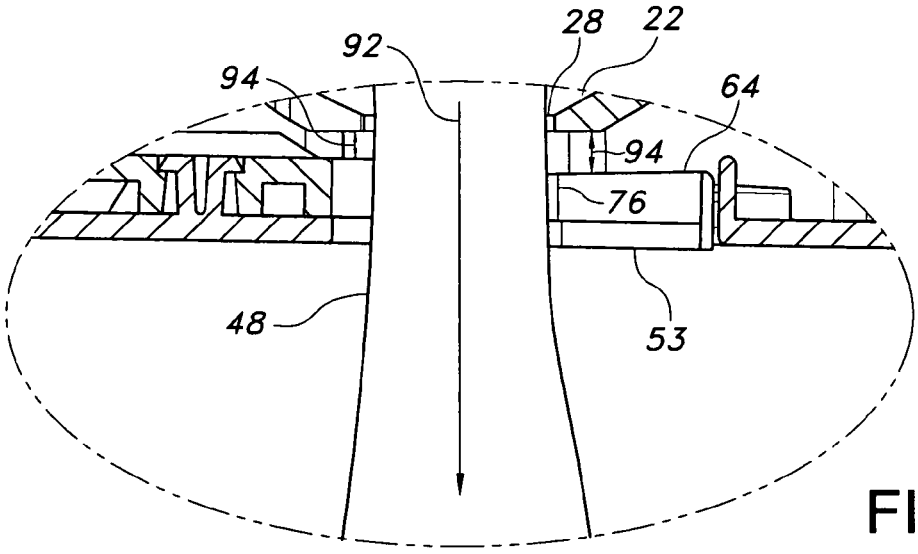
FIG. 8B is a partial sectional view of FIG. 8A taken along line 8B.
Figure 9A:
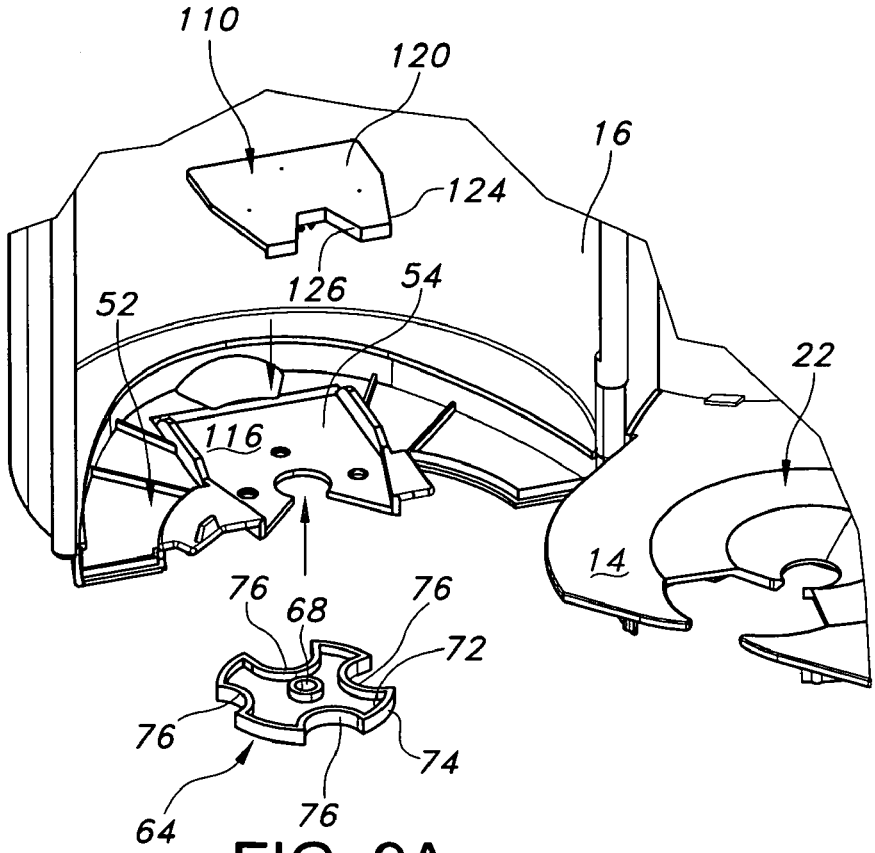
FIG. 9A is a partial perspective exploded view of another embodiment of the dispenser of the present invention, showing an adapter plate positioned above the mounting plate and the rotatable disk positioned below the mounting plate.
Figure 9B:
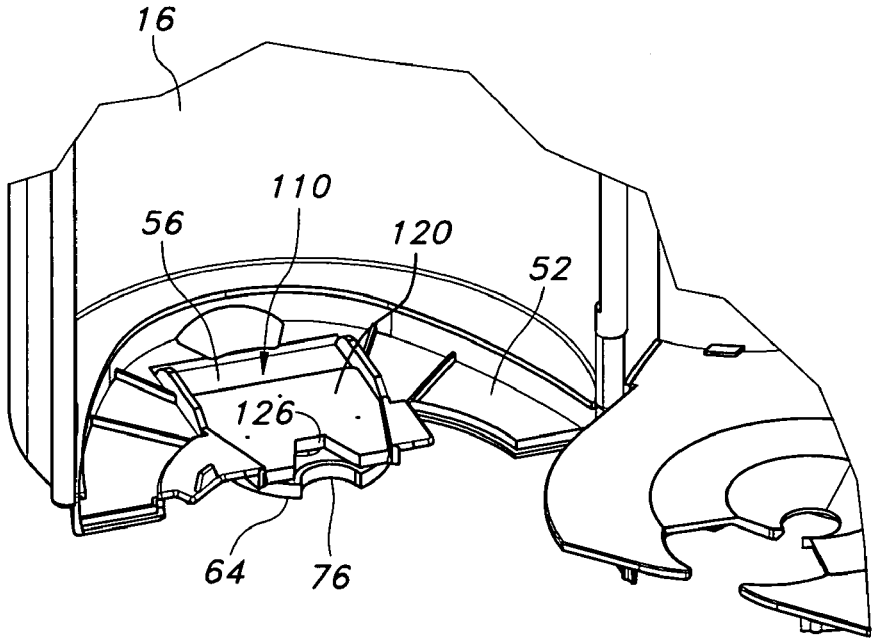
FIG. 9B is a perspective view of the embodiment of FIG. 9A, but showing the adapter plate positioned on the mounting plate and the rotatable disk positioned below the mounting disk.
Figure 10:
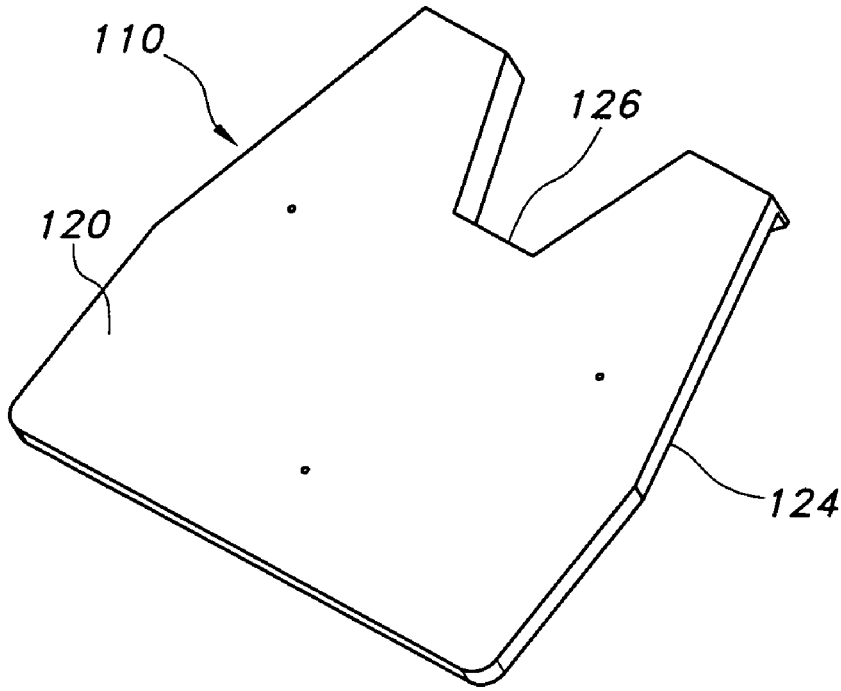
FIG. 10 is a top perspective view of the adapter plate of FIGS. 9A and 9B.
Figure 11:
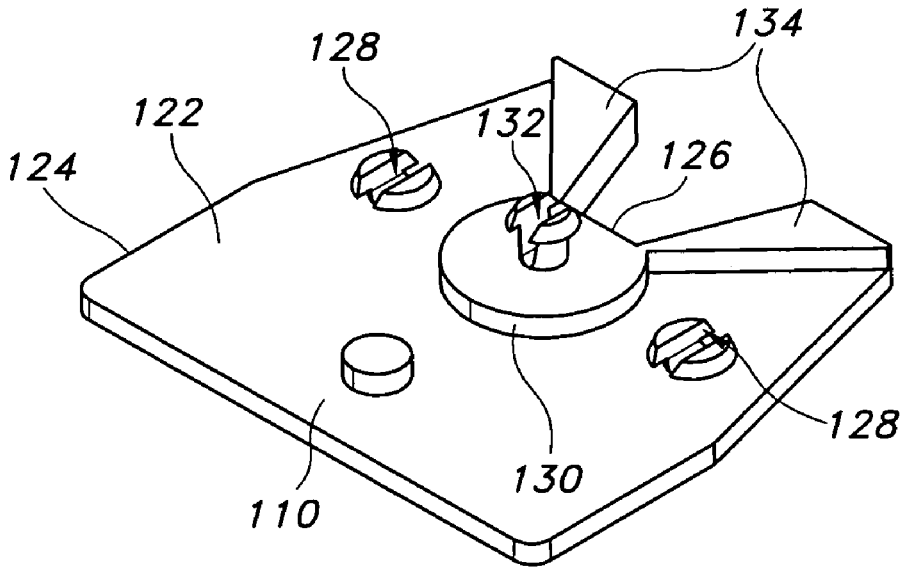
FIG. 11 is a bottom perspective view of the adapter plate of FIG. 10.
Figure 12:
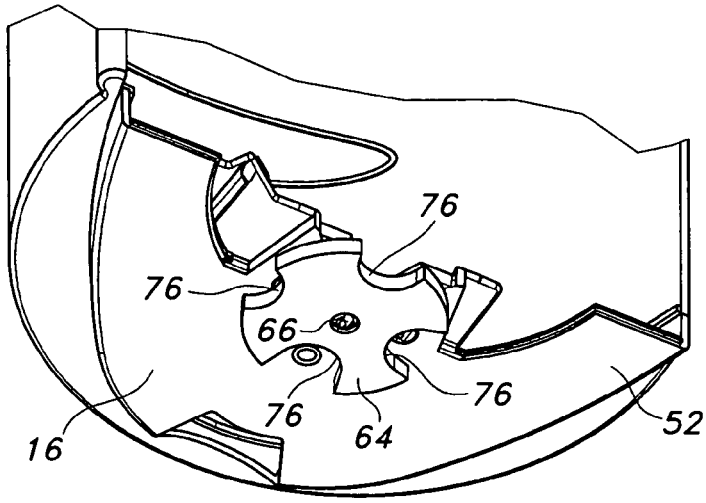
FIG. 12 is a partial perspective view of the lower end of the dispenser, but showing the rotatable disk positioned on the lower surface of the mounting plate.
Figure 13:
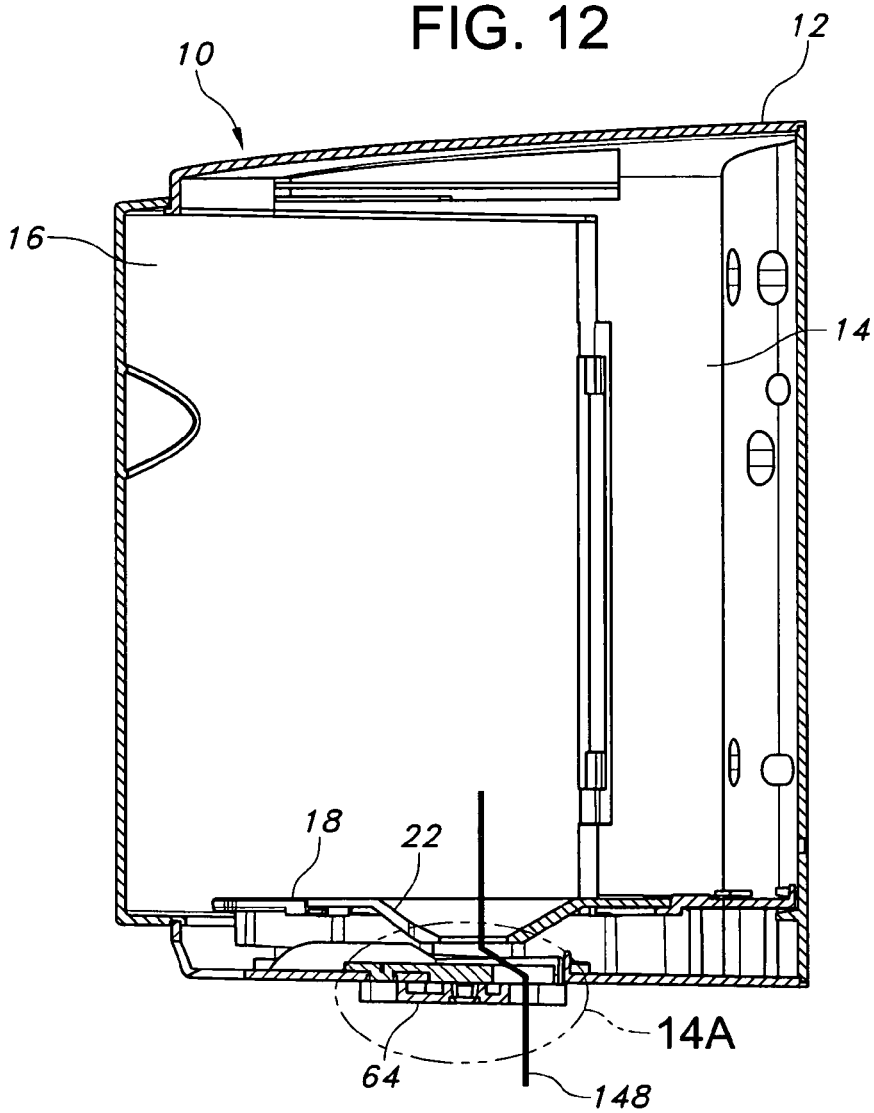
FIG. 13 is a side view of the upper portion of the dispenser and a sectional view similar to FIG. 8A slowing the lower end of the dispenser.

Accordingly, as illustrated in FIGS. 7A and 7B, the sheet material 48 follows a path 92 from the dispensing disk 22 in the roll platform 18 through the dispensing opening 28 and open feed section through a first space 94. The space 94 is positioned between the dispensing disk and the selected one of the dispensings slots 76 of the rotatable disk 64. When the sheet material 48 flows through the space 94, the sheet material 48 has no contact with any housing component while the sheet material 48 is in the space 94. The surrounding housing components are all spaced a distance away from the space 94. The compenents of the housing 12 are all spaced a distance away from the space 94 through which the sheet material 48 flows. The sheet material 48 is directed by the selected dispensing slot 76 in the rotatable disk 64 through the slot 60 of the mounting plate 56 and out of the exit port 40 provided by the lower end 53 of the housing 12. In this example, the sheet material 48 is in axial alignment on generally vertical axis 96. Examples of adjustment of the selected dispensing slot 76 which dispensings the diameter of the various openings and slots 28, 76 and 60 is illustrated in FIGS. 5B, 7A and 7B. It is notable in this adjustment that the general vertical alignment is maintained.

When one of the dispensing slots 76 of the rotatable disk 64 is offset, the vertical alignment is broken, and the sheet material 48 follows a non-aligned, non-axial path 98, as illustrated in FIG. 5C. Additional dispensing of the appropriate flow of sheet material 48 to facilitate proper dispensing is achieved by this additional dispensing choice.

Such dispensing choices provide increased frictional resistance to the flow of sheet material or decrease frictional resistance to such flow. The selections are made so that sheet materials having various basis weights, calipers, tab strengths and so forth may be loaded into the dispenser 10 and properly dispensed. Therefore, a choice is provided by the rotatable disk to control both the diameter of the opening through which sheet material flows, and to control the path of the flow of sheet material, i.e., in axial alignment (FIG. 5B) or non-axial alignment (FIG. 5C). Proper dispensing, that is, dispensing one sheet material at a time to a user, is maintained. In this manner, excess dispensing, which causes waste, and inadequate dispensing, which causes user frustration, may be avoided.

In a method of use of installing a sheet material 48 in a dispenser 10, a dispenser 10 having a housing 12 including a base 14 and a cover 16 is provided. The housing includes an exit port 40 as well. An operator opens the housing 12 to place it in an open loading position by releasing the cover 16 and moving the cover 16 away from the base 14 so that the roll platform 18 may be accessed. The roll platform 18 desirably includes the dispensing disk 22 having a dispensing opening 28 and open feed slot or section 40 formed therein. The dispensing opening 28 in the dispensing disk is positioned away from the back plate 17 of the base 14. The centerflow roll 46 of sheet material 48 is disposed on the roll platform 18, and a leading edge 99 of the sheet material 48 is threaded through the open feed slot or section 30 into the dispensing slot 28. The leading edge 99 is positioned to extended a distance away therefrom such that it extends beyond the dispenser housing 12. The rotatable disk 64 on the mounting plate 56 on the lower end portion 52 of the cover is then rotated and a dispensing slot 76 is selected. The dispensing slot 76 may be aligned axially with the slot 60 in the mounting plate 56, if axial alignment is desired to control dispensing, so that the sheet material dispensed therefrom follows an axially aligned path 92 through the exit port 40. The selected one of the plurality of dispensing slots 76 in the rotatable disk 76 is positioned toward the back plate 17 when the dispenser 10 is an a closed, dispensing position. Alternatively, for proper dispensing, the dispensing slot 76 may be positioned in a non-axially aligned position so that the sheet material 48 dispensed therefrom follows a non-axially aligned, non-axial path 98 through the exit port 40. The cover 16 of the dispenser housing 12 is then closed, and the leading edge 99 of the sheet material 48 extends from the exit port 40. It will be appreciated that, when the dispensing disk 22 is formed as a separate component, that several dispensing disks may be provided and the dispensing disk 22 may also be selected according to a diameter of the dispensing opening 28 therein to provide additional control over proper dispensing of sheet material 48 from the dispenser 10. The sheet material 48 disposed in the dispenser 10 flows between the dispensing opening 28 in the dispensing disk 22 through at least one space 94, through the selected one of the plurality of dispensing slots 76 of the rotatable disk 64 and through the exit port 40 to be dispensed.

In another embodiment of the invention shown in FIGS. 9–14B, the dispenser 10 shown in FIGS. 1–8B and described previously in detail in herein is used, except that the dispenser 10 now includes an adapter plate 110 which is mounted to an upper surface 112 of the mounting plate and a rotatable disk 64 which is mounted to a lower surface 116 of the mounting plate 56. The adapter plate 110 desirably comprises an upper surface 120 which is a substantially flat planar surface and a lower surface 122. The adapter plate 110 has a peripheral edge 124 which includes, but not by way of limitation, a U-shaped or V-shaped slot 126 therein. The adapter plate 110 is desirably mounted to the mounting plate 56. The adapter plate 110 and slot 126 therein is positioned to extend further outward relative to the mounting plate 56 and slot 60 therein. The lower surface 120 of the adapter plate includes snaps 128 which releasably couple to mounting apertures 59 in the mounting plate 56. In addition, the lower surface 116 includes a circular spacer 130 having a snap 132 thereon, and spacer flanges 134 positioned on the lower surface 120 adjacent the peripheral edge 124 of the slot 126. Snap 66 extends through the mounting disk aperture 58 to couple the rotatable disk 64 to the lower surface 116 of the mounting plate 56. This configuration moves the rotatable disk 64 horizontally closer to the back plate 17 of the base 14 when the dispenser is in a closed, dispensing position, as compared to its previous location shown and described herein.

Figure 14A:
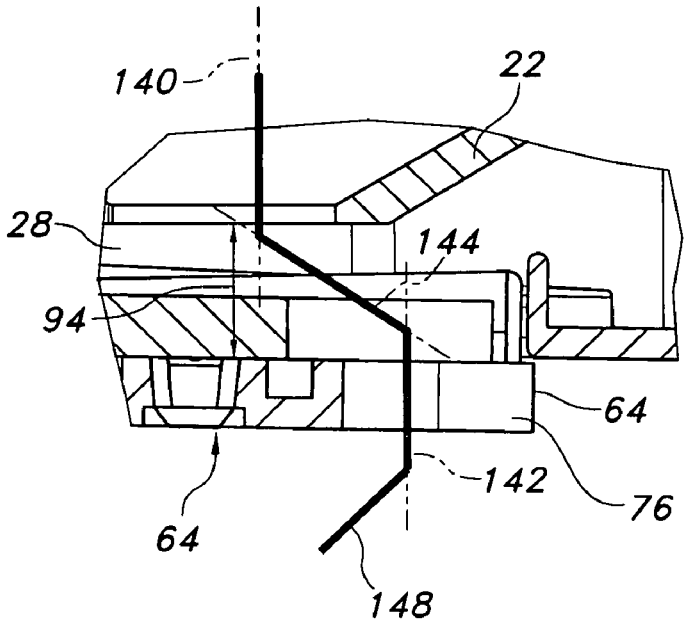
FIG. 14A is a partial sectional view of the dispenser of FIG. 13 taken along line 14A.
Figure 14B:
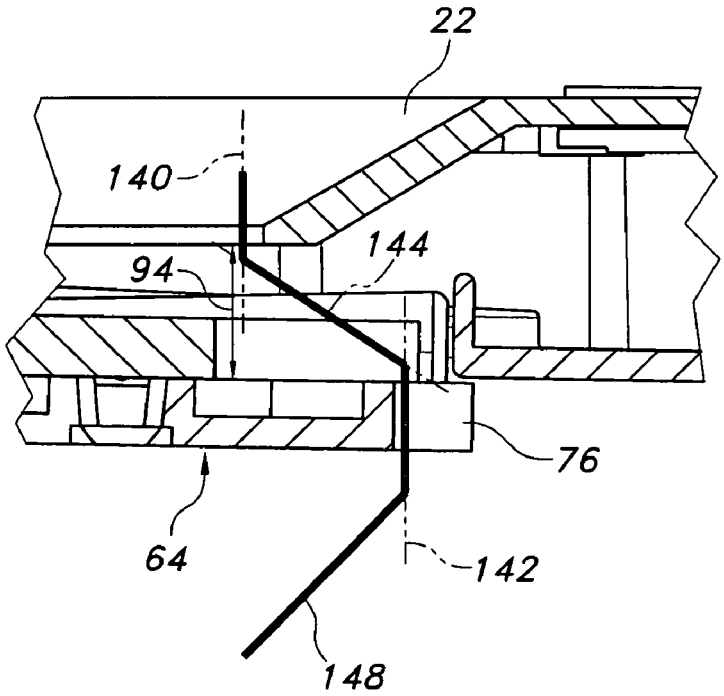
FIG. 14B is a partial sectional view similar to FIG. 14A.

This new location of the rotatable disk results in a circuitous, non-axially aligned path 138 through which the sheet material 48 flows from the roll platform 18 and out of the exit port 40. This non-axially aligned path is usually in the shape of a "Z" or "S" when viewed in a side sectional view of the dispenser 10, as shown in FIGS. 14A and 14B. In this manner, the diameter of the opening 28 in the dispensing disk 22 and/or the selected dispensing slot 76 of the rotatable disk 64 may be selected by an operator. It will be appreciated that this configuration always results in the non-axial, non-aligned path 138. Therefore, the sheet material 48 flows on a generally first vertical axis 140 through the dispensing opening 28 of the dispensing disk 64. Similarly, the sheet material 48 from the slot 126 of the adapter plate through the space 94, through the selected dispensing slot 76 of the rotatable disk 64 and through the exit port 40 of the dispenser 10 on a second vertical axis 142 which is generally parallel to the first vertical axis 140. The sheet material 48 flows from the dispensing opening 28 of the dispensing disk 22 through a first space 94 to the slot 126 in the adapter plate 110 on an oblique third axis 144 which intersects both the first axis 140 and the second axis 142.

It will be appreciated that the method of use is substantially similar to the method previously described and shown herein. However, due to the offset position of the adapter plate 110 and the rotatable disk 64 in this embodiment, it will be understood that the dispensing slot 76 need not be only partially aligned or off-set, because a non-axially aligned path which is a circuitous path 148 has already been created by the position of the components.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A dispenser adapted to dispense sheet material, the dispenser comprising:

a housing including a base and a cover, the base including a platform and a back plate configured to support sheet material thereon, the platform including a dispensing disk and the platform having an outer perimeter intersected by a slot thereby providing an opening into the platform and dispensing disk, the housing formed to include an exit port spaced apart from the platform and dispensing disk, the cover including a rotatable disk having a plurality of user interchangeable dispensing slots of differing diameters intersecting an outer periphery of the rotatable disk such that sheet material positioned on the platform flows through the dispensing opening of the dispensing disk and through a selected one of the plurality of dispensing slots, the selected one of the plurality of dispensing slots axially aligned with the exit port, wherein sheet material disposed in the dispenser flows between the opening in the dispensing disk, through at least one space, through the selected one of the plurality of dispensing slots and the exit port to be dispensed.

2. The dispenser of claim 1, wherein the dispensing disk is formed as a separate disk which is releasably carried by the platform.

3. The dispenser of claim 1, wherein the dispensing disk is formed integrally with the platform.

4. The dispenser of claim 1, wherein a portion of the slot is sized larger than the dispensing opening of the dispensing disk.

5. The dispenser of claim 4, wherein sheet material flows through the slot and the dispensing opening of the dispensing disk.

6. The dispenser of claim 5, wherein the selected one of the plurality of dispensing slots of the rotatable disk captures and directs the sheet material flowing through the slot and the dispensing opening into the exit port.

7. The dispenser of claim 1, wherein the dispensing opening in the dispensing disk is positioned away from the back plate.

8. The dispenser of claim 1, wherein the selected one of the plurality of dispensing slots in the rotatable disk is positioned toward the back plate when the dispenser is in the closed, dispensing position.

9. The dispenser of claim 1, wherein the dispensing opening in the dispensing disk is positioned away from the back plate, and wherein the selected one of the plurality of dispensing slots in the rotatable disk is positioned toward the back plate when the dispenser is in the closed, dispensing position.

10. The dispenser of claim 1, wherein the selected one of the plurality of dispensing slots in the rotatable disk permits adjustment of the alignment of the sheet material as it flows from the platform to the exit port.

11. The dispenser of claim 10, wherein the selected one of the plurality of dispensing slots in the rotatable disk permits the sheet material to flow in an axial alignment from the platform to the exit port.

12. The dispenser of claim 10, wherein the selected one of the plurality of dispensing slots in the rotatable disk permits the sheet material to flow in a non-axial alignment from the platform to the exit port.

13. The dispenser of claim 1, wherein the dispensing opening in the dispensing plate is positioned on a first axis and the exit port is positioned on a second axis.

14. The dispenser of claim 13, wherein the sheet material positioned between the platform the exit port is disposed on a third axis.

15. A dispenser adapted to dispense sheet material, the dispenser comprising:

a housing including a base and a cover, the base including a platform and a back plate configured to support sheet material thereon, the platform including a dispensing disk and the platform having an outer perimeter intersected by a slot thereby providing an opening into the platform and dispensing disk, the housing formed to include an exit port spaced apart from the platform and dispensing disk, the cover including a rotatable disk having a plurality of user interchangeable dispensing slots of differing diameters intersecting an outer periphery of the rotatable disk such that sheet material positioned on the platform flows through the dispensing opening of the dispensing disk and through a selected one of the plurality of dispensing slots, the selected one of the plurality of dispensing slots axially aligned with the exit port, wherein sheet material disposed in the dispenser is positioned to flow between the opening in the dispensing disk and the selected one of the plurality of dispensing slots, a space existing between the dispensing disk and the selected one of the dispensing slots of the rotatable disk and the sheet material having no contact with any housing component while flowing through the space, and wherein the sheet material flows through the dispensing slot and exit port for dispensing therefrom.

16. The dispenser of claim 15, wherein the dispensing disk is formed as a separate disk which is releasably carried by the platform.

17. The dispenser of claim 15, wherein the dispensing disk is formed integrally with the platform.

18. The dispenser of claim 15, wherein the dispensing opening in the dispensing disk is positioned away from the back plate, and wherein the selected one of the plurality of dispensing slots in the rotatable disk is positioned toward the back plate when the dispenser is in the closed, dispensing position.

19. The dispenser of claim 15, wherein the selected one of the plurality of dispensing slots in the rotatable disk permits adjustment of the alignment of the sheet material as it flows from the platform to the exit port.

20. The dispenser of claim 19, wherein the selected one of the plurality of dispensing slots in the rotatable disk permits the sheet material to flow in an axial alignment from the platform to the exit port.

21. The dispenser of claim 19, wherein the selected one of the plurality of dispensing slots in the rotatable disk permits the sheet material to flow in a non-axial alignment from the platform to the exit port.

22. A dispenser adapted to dispense sheet material, the dispenser comprising:

a housing including a base and a cover, the base including a platform and a back plate configured to support sheet material thereon, the platform including a dispensing disk and the platform having an outer perimeter intersected by a slot thereby providing an opening into the platform and dispensing disk, the opening in the dispensing disk positioned on a first axis, the housing formed to include an exit port spaced apart from the platform and dispensing disk, the exit port positioned on a second axis, the cover including a rotatable disk having a plurality of user interchangeable dispensing slots of differing diameters intersecting an outer periphery of the rotatable disk such that sheet material positioned on the platform flows through the dispensing opening of the dispensing disk and through a selected one of the plurality of dispensing slots, the one of the plurality of dispensing slots axially aligned with the exit port, wherein sheet material disposed in the dispenser flows between the opening in the dispensing disk and the exit port on a third axis.

23. The dispenser of claim 22, wherein the dispensing disk is formed as a separate disk which is releasably carried by the platform.

24. The dispenser of claim 22, wherein the dispensing disk is formed integrally with the platform.

25. The dispenser of claim 22, wherein the dispensing opening in the dispensing disk is positioned away from the back plate, and wherein the selected one of the plurality of dispensing slots in the rotatable disk is positioned toward the back plate when the dispenser is in the closed, dispensing position.

26. The dispenser of claim 22, wherein the selected one of the plurality of dispensing slots in the rotatable disk permits adjustment of the alignment of the sheet material as it flows from the platform to the exit port.

27. The dispenser of claim 26, wherein the selected one of the plurality of dispensing slots in the rotatable disk permits the sheet material to flow in an axial alignment from the platform to the exit port.

28. The dispenser of claim 26, wherein the selected one of the plurality of dispensing slots in the rotatable disk permits the sheet material to flow in a non-axial alignment from the platform to the exit port.

29. A dispenser adapted to dispense sheet material, the dispenser comprising:

a housing including a base and a cover, the base including a platform and a back plate configured to support sheet material thereon, the platform including a dispensing disk and the platform having an outer perimeter intersected by a slot thereby providing an opening into the platform and dispensing disk, the housing formed to include an exit port spaced apart from the platform and dispensing disk, the cover including a rotatable disk having a plurality of user interchangeable dispensing slots of differing diameters intersecting an outer periphery of the rotatable disk such that sheet material positioned on the platform flows through the dispensing opening of the dispensing disk and through a selected one of the plurality of dispensing slots, the selected one of the plurality of dispensing slots axially aligned with the exit port, wherein the housing is formed to include a space between the dispensing disk and the rotatable disk such that sheet material flowing therebetween has no contact with any housing component while in the space, and wherein when the housing is positioned in an open loading position such that the cover is moved away from the base, sheet material disposed on the platform is positioned such that a portion of the sheet material extends through the opening in the dispensing disk and at least a leading edge of the sheet material extends below the housing, and wherein when the cover is closed against the base to place the housing in a closed dispensing position, the sheet material flows through the space between the dispensing disk and the rotatable disk into the selected one of the plurality of dispensing slots in the rotatable disk and through the exit port.

30. The dispenser of claim 29, wherein the dispensing disk is formed as a separate disk which is releasably carried by the platform.

31. The dispenser of claim 29, wherein the dispensing disk is formed integrally with the platform.

32. The dispenser of claim 29, wherein the dispensing opening in the dispensing disk is positioned away from the back plate, and wherein the selected one of the plurality of dispensing slots in the rotatable disk is positioned toward the back plate when the dispenser is in the closed, dispensing position.

33. The dispenser of claim 29, wherein the selected one of the plurality of dispensing slots in the rotatable disk permits adjustment of the alignment of the sheet material as it flows from the platform to the exit port.

34. The dispenser of claim 33, wherein the selected one of the plurality of dispensing slots in the rotatable disk permits the sheet material to flow in an axial alignment from the platform to the exit port.

35. The dispenser of claim 33, wherein the selected one of the plurality of dispensing slots in the rotatable disk permits the sheet material to flow in a non-axial alignment from the platform to the exit port.

36. The dispenser of claim 29, wherein the dispensing opening in the dispensing plate is positioned on a first axis and the exit port is positioned on a second axis, and wherein the sheet material positioned between the platform the exit port is disposed on a third axis.

* * * * *